US006550173B2

(12) United States Patent
Pescini

(10) Patent No.: US 6,550,173 B2
(45) Date of Patent: Apr. 22, 2003

(54) SEMIAUTOMATIC RIFLE WITH INERTIAL OPERATION

(75) Inventor: Giuseppe Pescini, Rovato (IT)

(73) Assignee: Fabram S.p.A. Fabbrica Bresciana Armi, Travagliato (IT)

( * ) Notice: Subject to any disclaimer, the term of this patent is extended or adjusted under 35 U.S.C. 154(b) by 0 days.

(21) Appl. No.: 09/887,800

(22) Filed: Jun. 22, 2001

(65) Prior Publication Data

US 2002/0005004 A1 Jan. 17, 2002

(30) Foreign Application Priority Data

Jul. 14, 2000 (IT) ..... MI00A1598

(51) Int. Cl.[7] ..... F41A 3/00
(52) U.S. Cl. ..... 42/17; 89/182
(58) Field of Search ..... 42/17; 89/182, 89/183

(56) References Cited

U.S. PATENT DOCUMENTS 1,057,329 A * 3/1913 Clarus ..... 89/154
1,946,388 A * 2/1934 Chevallier ..... 89/182
2,466,902 A * 4/1949 Lochhead ..... 89/182
2,499,090 A * 2/1950 Browning ..... 89/176
3,893,369 A * 7/1975 Benelli ..... 89/182
4,601,122 A * 7/1986 Beretta ..... 42/21
4,938,116 A * 7/1990 Royster ..... 89/198
5,457,901 A * 10/1995 Gernstein et al. ..... 42/1.06
5,983,549 A * 11/1999 Battaglia ..... 42/17

* cited by examiner

*Primary Examiner*—Michael J. Carone
*Assistant Examiner*—John W. Zerr
(74) *Attorney, Agent, or Firm*—Hedman & Costigan, P.C.

(57) ABSTRACT

A semiautomatic rifle (10) with inertial operation comprises an arming unit (11) and an inertial-loading device (12), where the arming unit (11) has a breechblock (13), there being housed inside the breechblock (13) a firing pin (18), and further has a cocking lever (21) equipped with a corresponding spring (22) and with a kinetic mass (23), as well as with a magazine follower (24) designed to transfer the cartridges (20) supplied by the magazine box (25) of the inertial-loading device (12) to the arming unit (11). The arming unit (11) is functionally associated with the inertial-loading device (12) for loading the cartridges (20) in such a way that it is possible to exploit the inertia associated to the recoil of the rifle when the rifle is fired, both for operation of the arming unit (11) and for feed of the cartridges (20) from the magazine box (25) to the cartridge chamber.

6 Claims, 4 Drawing Sheets

SEMIAUTOMATIC RIFLE WITH INERTIAL OPERATION

The present application claims priority to Italian Patent Application Serial No. MI 2000A 001598, filed Jul. 14, 2000.

BACKGROUND OF THE INVENTION

The present invention refers to a semiautomatic rifle with inertial operation.

Known to the art are inertial or kinetic rifles with a fixed barrel, in which the feed mechanism that re-arms the loading mechanism is operated by the kinetic energy of the recoil.

In particular, in what follows reference will be made to a smooth-bore rifle, in particular in the various calibres 12-20-28, equipped with a semiautomatic loading device with inertial or kinetic operating principle, i.e., to a rifle equipped with a so-called mixed (semiautomatic-pump) loading device, where the semiautomatic function is in any case determined by the kinetic principle.

For some time now there have been present on the market rifles with kinetic operation which have a kinetic spring located between the breechblock body and the closing head inside the chassis of the rifle.

When the rifle has been fired, the breechblock of the semiautomatic rifle, on account of the kinetic reaction, which has a direction opposite to the recoil force, advances from the closing position along a central axis of symmetry in the same direction as the projectiles that have been shot, compressing the kinetic spring.

The kinetic spring, thus compressed, accumulates energy, which it releases subsequently, expanding and causing backing-off of the breechblock, which draws backwards the feed mechanism, which in turn rearms the loading mechanism.

During the backing-off motion, all the mechanisms that complete the cycle of operation of the rifle are actuated preparing the rifle for being fired again.

It should be noted, however, that known semiautomatic rifles of this sort have a loading device that presents large overall dimensions. In fact, given the location and overall dimensions of the kinetic spring, the arming unit, as well as the receiver, require appropriate geometries and dimensions, and, above all, in the horizontal direction along the axis of the firing pin, the arming unit and the receiver are longer than those of rifles that adopt other operating principles. This sets limits both on the minimum overall dimensions for the weapon and on its appearance, which, instead, should be as compact and as streamlined as possible.

It is moreover evident that a kinetic rifle, at the industrial-production level, must be developed purposely since it cannot be easily derived from weapons with different operating principles.

It should also be noted that the kinetic spring, which constitutes the essential element of kinetic loading devices and which determines the characteristics of operation of the rifle, is, in traditional embodiments, constrained by narrow geometrical and dimensional limits. This prevents its optimization in terms of comfort for the user and in terms of limitation of stresses for the weapon.

A second problem with known semiautomatic rifles results from the fact that, in order to load the rifle, it is generally necessary to release the magazine follower, press it, and keep it pressed during loading of all the cartridges, so as to prevent the magazine follower from getting jammed after insertion of each cartridge.

In order to unload rifles equipped with known gunlocks without firing them, it is possible to proceed either by acting on the breechblock, simulating normal operation of the weapon, or else by turning the weapon upside down, releasing the magazine follower, inserting a finger inside the loading gate, and actuating the bolt handle from inside as many times as there are cartridges contained in the magazine box.

SUMMARY OF THE INVENTION

The above-mentioned operations are laborious, occupy both hands, and require a certain manual skill above all if, during said operations, the cartridges are handled without the possibility of putting them down and if the user wishes to prevent them from being dropped on the ground.

A purpose of the present invention is, therefore, to provide a semiautomatic rifle with inertial operation which is able to solve the aforementioned problems.

Another purpose of the present invention is to provide a semiautomatic rifle with inertial operation which has small overall dimensions and which thus enables the dimensions of the receiver to be contained.

A further purpose of the present invention is to provide a semiautomatic rifle with inertial operation which presents advantages in terms of high comfort for the user and in terms of limitation of stresses for the weapon itself.

Yet another purpose of the present invention is to provide a semiautomatic rifle with inertial operation which mounts a gunlock that enables easy operations of loading and unloading without any need for the weapon to be fired.

These and other purposes are achieved by a semiautomatic rifle with inertial operation, comprising an arming unit (11) and an inertial-loading device (12), wherein said inertial-loading device (12) comprises an inertial-spring elastic element (35) inserted in a blind hole (36) of a compression mass (37), wherein said arming unit (11) comprises a breechblock (13), said breechblock (13) housing a firing pin (18), and further comprising a cocking lever (21) equipped with a corresponding spring (22) and with a kinetic mass (23), wherein said spring (22) and said kinetic mass (23) are contained within the movable distance of said arming unit (11), a magazine follower (24) designed to transfer the cartridges (20) supplied by a magazine box (25) of said inertial-loading device (12) to said arming unit (11), wherein said magazine box (25) of the inertial-loading device (12) has an opposite end provided with a blind end made by means of at least one plug-like extension (27) of at least one rod (28), which carries a knob (29), on a front free end of said rod (28) wherein the end of a spring (34), blocked by a shaped bushing (38), is inserted on said magazine box (25), said spring (34) bearing upon an extension (26) of a receiver (16) of said rifle (10), wherein said arming unit (11) being functionally associated with said inertial-loading device (12) for loading the cartridges (20) so as to exploit the inertia associated with the recoil of the rifle when the rifle is fired, both for operation of said arming unit (11) and for feeding said cartridges (20) from said magazine box (25) to the cartridge chamber.

Further characteristics of the present invention are moreover defined in the remaining claims annexed to the present application.

Advantageously, the functions of the weapon as a whole in all cases derive from the kinetic effect following upon firing and not before said firing takes place. This makes it possible to exploit the kinetic energy that is released upon firing in the most complete way, i.e., not just partially.

Also major advantages are achieved in the simplification of the mechanical organization of the weapon, which is consequently rendered simpler, safer, and more convenient in its manufacture at an industrial level, allied to a reduced maintenance on the part of the user and a greater reliability in general, also on account of the presence of a smaller number of pieces as compared to the known art.

BRIEF DESCRIPTION OF THE DRAWINGS

Further purposes and advantages of the present invention will emerge clearly from the ensuing description and from the annexed drawings, which are provided purely to furnish an explanatory and non-limiting example, and in which.

DETAILED DESCRIPTION OF THE INVENTION

Figure 1:
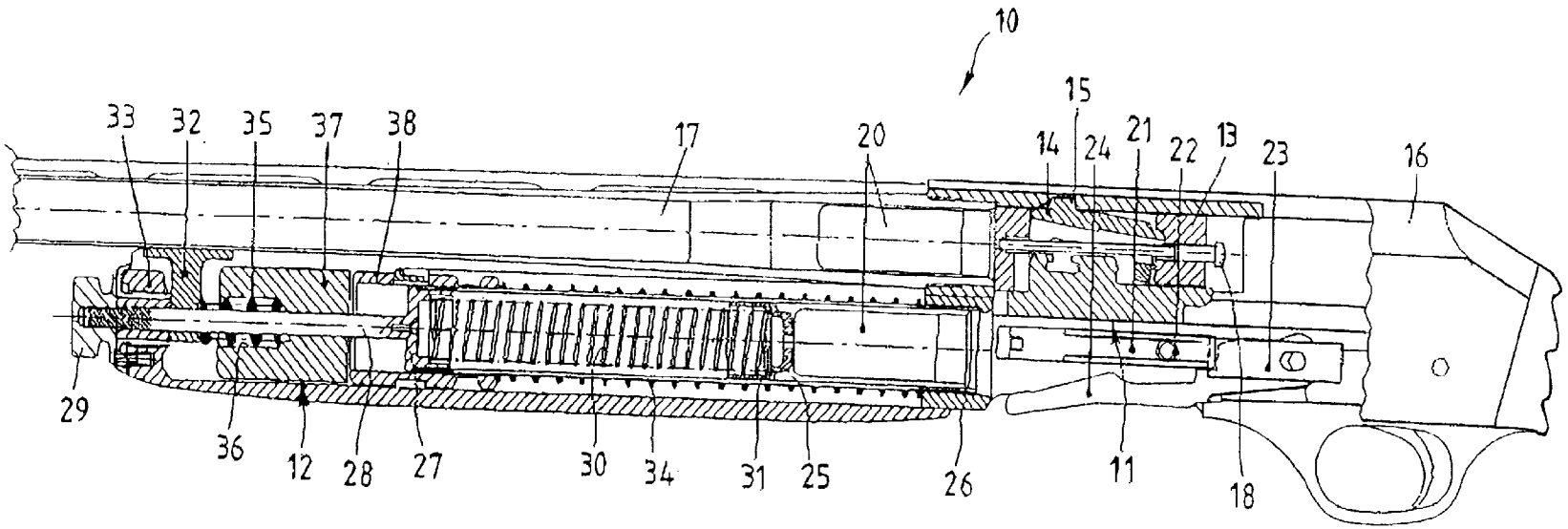
FIG. 1 is a partially sectional view of a semiautomatic rifle with inertial operation according to the present invention, in resting conditions.

With particular reference to the aforementioned figures, the semiautomatic rifle with inertial operation according to the present invention is designated, as a whole, by the reference number 10.

The rifle 10 has an arming unit 11 and an inertial-loading device 12.

The arming unit 11 consists of a breechblock 13, which is of the type, in itself known, with loading gate 14.

The loading gate 14 is housed inside the arming unit 11 and has a tooth-like projection 15 which can engage in a slot of a portion of the receiver 16 for firm and secure closing of a cartridge chamber of a barrel 17 of the rifle 10.

Also housed inside the breechblock 13 is a firing pin 18 provided with special springs (not shown for reasons of simplicity) to keep it in the resting position.

The arming unit 11 is functionally associated to the inertial-loading device 12 for loading the cartridges 20.

Figure 2:
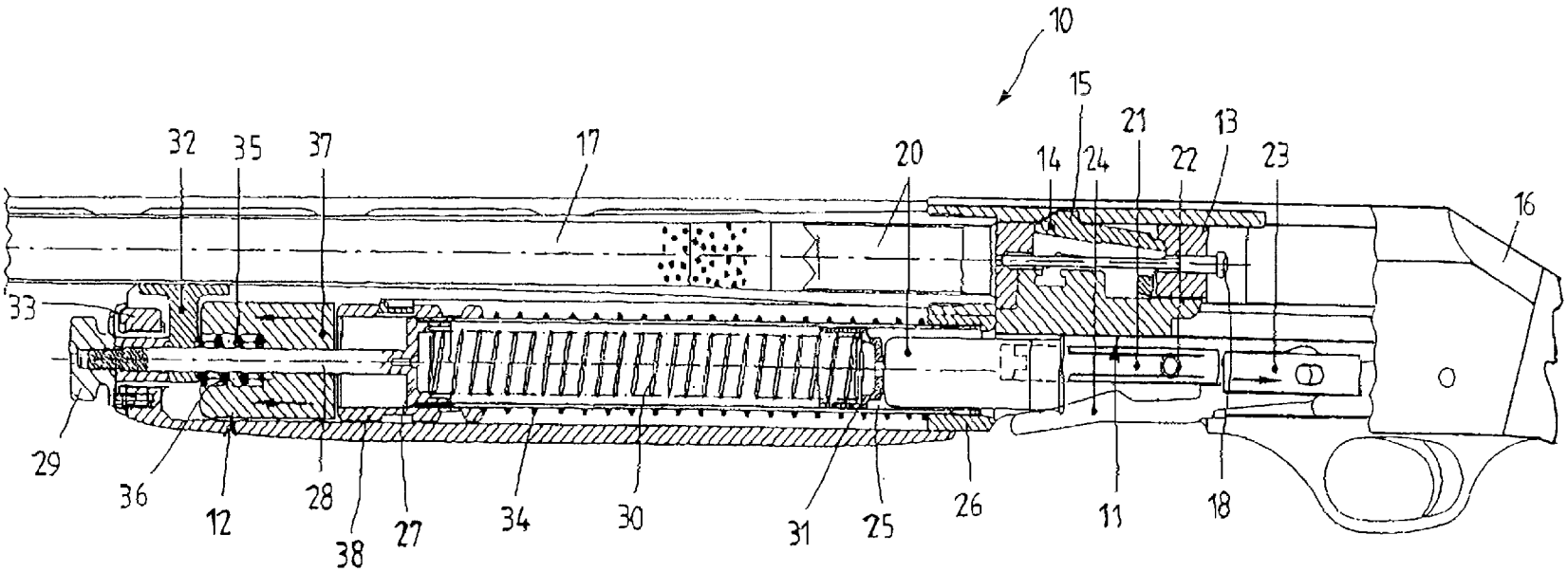
FIG. 2 is a partially sectional view of the rifle of FIG. 1, during firing.
Figure 3:
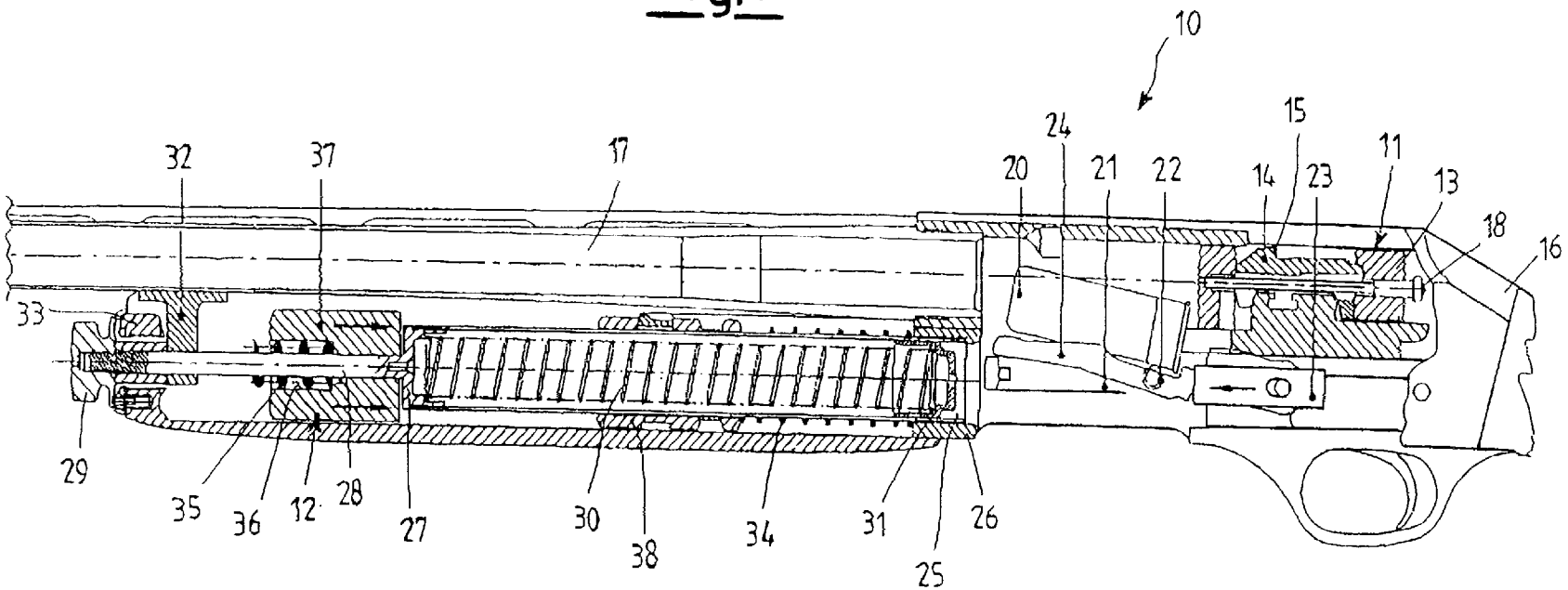
FIG. 3 is a partially sectional view of the rifle of the previous figures, after firing.
Figure 4:
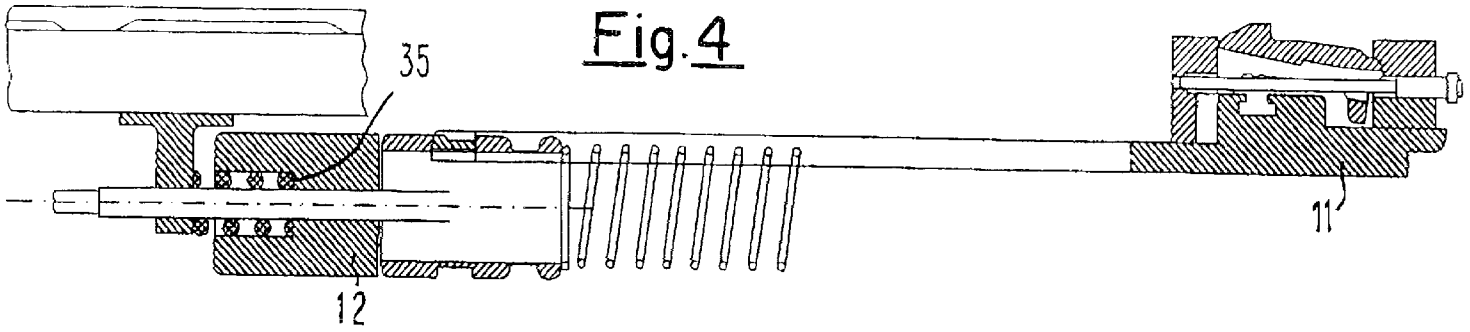
FIG. 4 is a partially sectional view of the inertial members of the rifle in the resting position.
Figure 5:
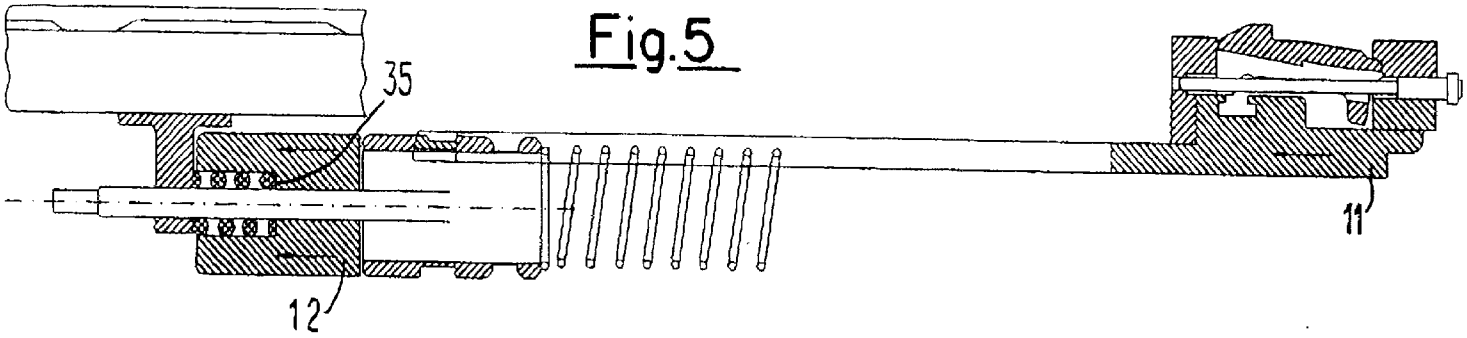
FIG. 5 is a partially sectional view of the inertial members of the rifle during firing.
Figure 6:
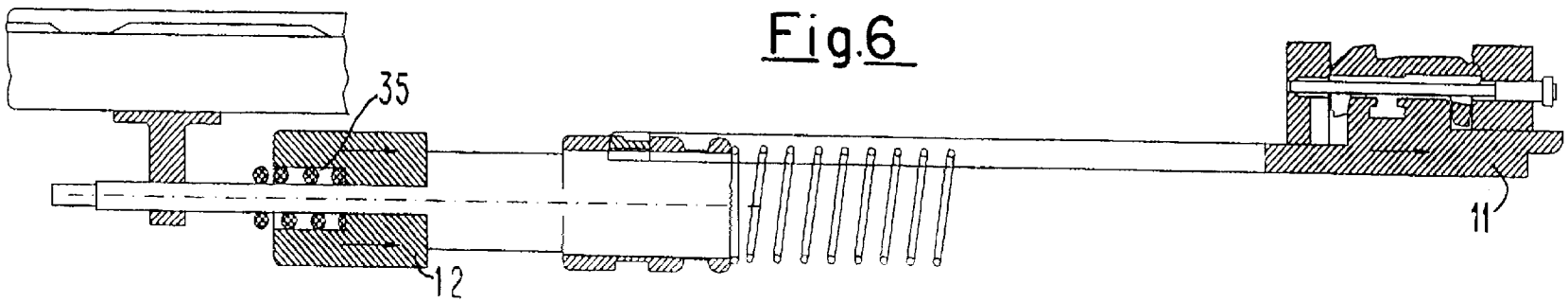
FIG. 6 is a partially sectional view of the inertial members of the rifle after firing.

In particular with reference to the inertial-loading device 12 for loading the cartridges 20, in FIGS. 1–3 there is visible a cocking lever 21 provided with a corresponding spring 22 and with a kinetic mass 23.

Also a magazine follower 24 is present, which is designed to transfer the cartridges 20 that are fed from the magazine box 25 of the inertial-loading device 12 to the arming unit 11.

The cartridge-feed mouth of the magazine box 25 is fixed to the receiver 16, it being locked in a sleeve-like extension 26 thereof.

The blind end of the magazine box 25 is made by means of a plug-like extension 27 of a rod 28 which carries, at its front end, i.e., its free end, a knob The plug extension 27 is screwed on the body of the magazine box 25 and carries a spring 30 which is provided, at its own free end, with a cap 31 which pushes the cartridges 20 contained within it towards the outlet mouth of the magazine box 25.

The rod 28 is supported in a through hole made on a barrel-guide ring 32 for fixing of the barrel 17 to the receiver 16, and in a bushing-like seat 33, which is integral with the ring 32 of the barrel 17.

A spring 34, blocked at one opposite end by a shaped bushing 38, is inserted on the magazine box 25; said spring 34 also bears upon the sleeve-like extension 26 of the receiver 16.

An inertial spring elastic element 35, inserted in a blind hole 36 of a compression mass 37, is provided on the rod 28 of the inertial-loading device 12, thus bearing upon the ring 32.

The inertial spring 35 may consist of a spiral-shaped or disk-shaped torsion spring.

The above elements are designed to accumulate part of the inertial energy due to recoil of the rifle 10.

The compression mass 37 is set in a front position with respect to said bushing 38, which is operatively connected to the breechblock 13 through an appendage of the loading mechanism, the latter being in itself known and not being shown for reasons of simplicity.

Operation of the semiautomatic rifle 10 with inertial operation according to the invention is basically as described in what follows.

In resting conditions, the rifle 10 is ready for firing, with the magazine follower 24 free to rotate. The magazine follower 24 is free on account of the presence of the kinetic mass 23, which prevents the cocking lever 21, pushed by the spring 22, from blocking the magazine follower 24.

When the rifle is fired, recoil of the rifle causes translation of the compression mass 37 by inertia in the same direction and in the same sense as the projectiles shot, causing compression of the inertial spring 35.

By the same inertial effect, the kinetic mass 23 draws back, allowing the cocking lever 21 to rotate, which thus blocks the magazine follower 24 and enables the cartridge 20 to come out of the magazine box 25.

It should be noted that the kinetic mass 23 could be constituted by the magazine follower 24 itself provided with a slot also for an axial displacement.

Next, the inertial spring 35 expands, releasing the accumulated energy and causing drawing-back of the arming unit 11 for a new firing cycle.

During this stage, the phases of expulsion of the spent cartridge case and of feed of the cartridge 20 from the magazine box 25 to the cartridge chamber take place.

The semiautomatic rifle 10 of the invention is thus ready to be fired again.

It is to be noted that exploitation of inertia according to the teachings of the present invention is understood as being applied and extended to weapons with loading gate closing or with roller or ball closing and in the presence of magazine follower free.

The characteristics, as well as the advantages, of the semiautomatic rifle with inertial operation which forms the subject of the present invention emerge clearly from the foregoing description.

Finally, it is clear that numerous variations may be made to the semiautomatic rifle with inertial operation which forms the subject of the present invention, without thereby departing from the principles of novelty inherent in the inventive idea.

In the practical implementation of the invention, the materials, shapes and dimensions of the items illustrated may be any whatsoever according to the requirements, and the said items may be replaced with others that are technically equivalent.

The scope of the invention is defined by the attached claims.

What is claimed is:

1. A semiautomatic rifle (10) with inertial operation, comprising an arming unit (11) and an inertial-loading device (12), wherein said inertial-loading device (12) comprises an inertial-spring elastic element (35) inserted in a blind hole (36) of a compression mass (37), wherein said arming unit (11) comprises a breechblock (13), said breechblock (13) housing a firing pin (18), and further comprising a cocking lever (21) equipped with a corresponding spring (22) and with a kinetic mass (23), wherein said spring (22) and said kinetic mass (23) are contained within the movable distance of said arming unit (11), a magazine follower (24) designed to transfer cartridges (20) supplied by a magazine box (25) of said inertial-loading device (12) to said arming unit (11), wherein said magazine box (25) of the inertial-loading device (12) has an opposite end provided with a blind end made by means of at least one plug-like extension (27) of at least one rod (28), which carries a knob (29), on a front free end of said rod (28) wherein the end of a spring (34), blocked by a shaped bushing (38), is inserted on said magazine box (25), said spring (34) bearing upon an extension (26) of a receiver (16) of said rifle (10), wherein said arming unit (11) being functionally associated with said inertial-loading device (12) for loading the cartridges (20) so as to exploit inertia associated with the recoil of the rifle when the rifle is fired, both for operation of said arming unit (11) and for feeding said cartridges (20) from said magazine box (25) to a cartridge chamber.

2. The semiautomatic rifle (10) according to claim 1, wherein said inertial spring (35) is chosen from the group consisting of a spiral-shaped or disk-shaped torsion spring.

3. The semiautomatic rifle (10) according to claim 1, wherein said plug-like extension (27) is screwed on the body of the magazine box (25) and includes a spring (30) at a free end of said plug like extension (27), further comprising a cap (31) which pushes the cartridges (20) contained within said magazine box (25) towards an outlet mouth of said magazine box (25).

4. The semiautomatic rifle (10) according to claim 1, wherein a recoil of said rifle (10) causes translation of said compression mass (37) by inertia in the same direction and in the same sense as the projectiles shot, causing compression of said inertial spring (35), said kinetic mass (23) drawing back, in order to allow said cocking lever (21) to rotate and to block said magazine follower (24), so as to enable cartridges (20) to come out of said magazine box (25).

5. The semiautomatic rifle (10) according to claim 4, wherein said kinetic mass (23) is constituted by said magazine follower (24) which is provided with a slot for its axial displacement.

6. The semiautomatic rifle (10) according to claim 1, wherein said breechblock (13) is of a loading gate (14) type, and said loading gate (14) is housed inside said arming unit (11) and has a tooth-like projection (15) which can engage in a slot of a portion of a receiver (16) for firm and secure closing of a cartridge chamber of a barrel (17) of said rifle (10).

* * * * *

UNITED STATES PATENT AND TRADEMARK OFFICE

CERTIFICATE OF CORRECTION

PATENT NO. : 6,550,173 B2
DATED : April 22, 2003
INVENTOR(S) : Giuseppe Pescini

It is certified that error appears in the above-identified patent and that said Letters Patent is hereby corrected as shown below:

Title page,
Item [73], Assignee, "Fabram S.p.A. Fabbrica Bresciana Armi" should be
-- Fabarm S.p.A. Fabbrica Bresciana Armi --

Signed and Sealed this

Second Day of September, 2003

JAMES E. ROGAN
*Director of the United States Patent and Trademark Office*